United States Patent [19]

Carmo

[11] 4,052,067

[45] Oct. 4, 1977

[54] COMBINED BALL AND FLEXIBLE TRACK

[76] Inventor: Robert A. Carmo, 28886 Alton Ave., Wickliffe, Ohio 44092

[21] Appl. No.: 731,130

[22] Filed: Oct. 12, 1976

[51] Int. Cl.[2] ..... A63F 7/00

[52] U.S. Cl. ..... 273/109

[58] Field of Search ..... 273/108, 109, 110, 86 C; 46/43; 238/10 E

[56] References Cited

U.S. PATENT DOCUMENTS

| | | | |
|---|---|---|---|
| 2,670,206 | 2/1954 | Brewster | 273/86 C |
| 3,697,075 | 10/1972 | Nania | 273/110 |
| 3,735,923 | 5/1973 | Brigham et al. | 238/10 E |

FOREIGN PATENT DOCUMENTS

| | | | |
|---|---|---|---|
| 2,051,624 | 4/1972 | Germany | 46/47 |
| 82,844 | 11/1953 | Norway | 273/108 |

*Primary Examiner*—Richard C. Pinkham
*Assistant Examiner*—Arthur S. Rose

[57] ABSTRACT

There is provided an amusement device characterized by an elongated flexible trackway of generally U-shaped cross section and having holders at each end of the trackway, particularly hand holders for holding the open end of the U-shaped cross section upwardly directed, and a spherical ball dimensioned for rolling contact with the track portion.

9 Claims, 4 Drawing Figures

FIG. 1
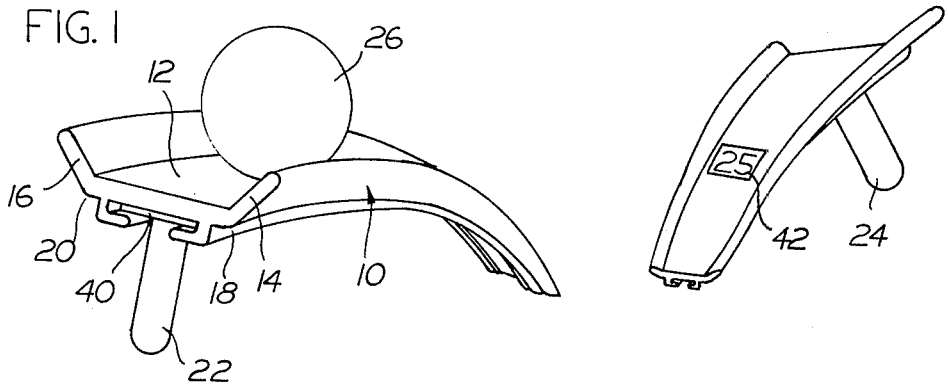
FIG. 2
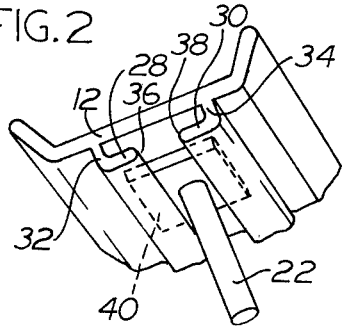
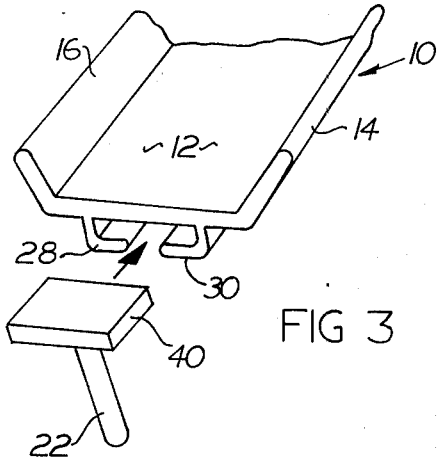
FIG 3
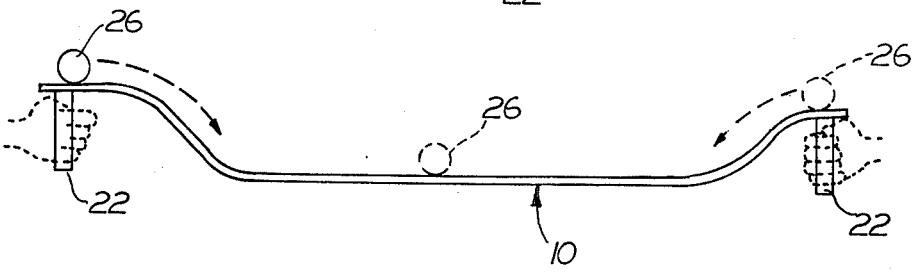
FIG. 4

COMBINED BALL AND FLEXIBLE TRACK

BACKGROUND OF THE INVENTION

The present invention relates as indicated to amusement device for game. The closest prior art of which I am aware is U.S. Pat. No. 3,697,075 which includes a pair of abutting flexible guide ways secured to a base support which is heavy enough to remain on the floor or table during play and includes means for trapping the article of play during a certain portion of the trackway. Alternate forms utilize rigid trackways which are pivoted at the central weighted portion.

BRIEF STATEMENT OF THE INVENTION

The present invention contemplates a game requiring considerable skill to master characterized by a trackway having upwardly extending side rails to provide a generally U-shaped flexible trackway of considerable length, e.g. 10–12 feet. Means are provided at each end of the trackway for holding the trackway and in particular, hand hold means, so that a game may be engaged in by two persons. A ball is provided for rolling contact along the trackway the game object being to transfer a ball from one player across the length of the track toward the other player without dislodgement thereof from the trackway. Numerical scoring indicia along the trackway enable tallying of a point total. Various modifications of the game involving utilizing the flexibility of the trackway to cause the ball to leave the trackway for at least a portion of its travel toward the other player and reenter the trackway for the completion thereof or return to the first player is contemplated. The trackway must be of uniform cross sectional configuration from one end to the other without any intervening mass so that various maneuvers can be executed by the players involving a variety of positions of the trackway.

BRIEF DESCRIPTION OF THE DRAWINGS

The present invention may be better understood by having reference to the annexed drawings wherein FIG. 1 is a fragmentary perspective view showing the ends of the flexible trackway with the handles attached and the ball resting in the trackway.

FIG. 2 is fragmentary perspective view from the underside of the trackway shown in FIG. 1 showing a mode of attaching a handle thereto.

FIG. 3 is an exploded perspective view of one end of the trackway showing the method of inserting a flange on the handle portion into receiving flanges integral with the bottom of the trackway.

FIG. 4 is a side elevation of the game apparatus of the present invention showing the trackway as held by two participants and the course followed by the ball when in play.

DETAILED DESCRIPTION

Referring now more particularly to FIG. 1 there is here shown an elongated trackway 10 having a bottom portion 12 and upwardly diverging side rails 14 and 16 along the respective marginal edges 18 and 20 of the trackway bottom 12. The angle of the side rails 14 and 16 to the plane of the top of the trackway may be preferably from 30°–less than 90°, especially 45°. Handles 22 and 24 are provided at each end for grasping by participants. A ball 26 is dimensioned to contact the bottom 12 and at least one of the side rails 14 or 16, and no larger than necessary to contact both side rails 14 and 16 and the bottom 12.

As best shown in FIG. 2, the bottom of the trackway is provided with integrally formed inwardly turned flanges 28 and 30. The flanges 28 and 30 are L-shaped members which are integral and co-extensive with the trackway 12 at 32 and 34 with the oppositely facing free edges 36 and 38 dimensioned to receive therebetween the handle 22, and to frictionally retain a rectangular portion 40 preferably a square secured to one end of the tubular handle 22. The lateral spacing of the ends 32 and 34 is likewise dimensioned to frictionally retain the flange 40 so that it is not easily removed in the course of play. Adhesive means may be used to secure the handles 22 in place if desired.

The device consists of four parts, therefore, the two handles 22 at each end of the trackway 10 and the ball 26. The elements of the apparatus are conveniently formed from a thermoplastic such as polyethylene or polypropylene. Usually a length of 10–12 feet and a thickness of the trackway and side walls about 1/16 inch is sufficient for these purposes. The track between the side rails 14 and 16 is conveniently 1.0 to 1.75 inch wide, and the rails 14 and 16 about 0.25 to 0.4 inch high. The trackway is conveniently formed by extrusion of a pigmented thermoplastic material. The ball may be formed of the same thermoplastic material or from rubber, or sponge rubber as desired. The handle portions are desirably somewhat more rigid although they too may be formed of the same thermoplastic material, e.g. polyethylene or polypropylene. Numerical scoring indicia 42 may be adhered to the surface of the trackway at preselected points indicating a height attained adjacent an opposite player without dislodgement of the ball and tallyed over a given number of attempts for a total comparative score.

The device is characterized by simplicity and inexpensive construction.

What is claimed is:

1. An amusement device comprising a. an elongated flexible trackway of generally U-shaped cross section defined by continuous side rails and a co-extensive relatively narrow bottom track portion therebetween, b. means at each end of said flexible trackway for holding said trackway said holding means being adapted to be hand held with the open end of the U-shaped cross section upwardly directed, each of said holding means consisting of a tube and a laterally projecting rectangular flange at one end, the underside of said trackway including c. means for holding said holding means with said flange being disposed against the underside of said trackway; and d. a spherical ball dimensioned for rolling contact with the bottom track portion and with at least one of said side rails.

2. An amusement device in accordance with claim 1 wherein the ball is dimensioned for rolling contact with the bottom track portion and no more than one side rail at any given time.

3. An amusement device in accordance with claim 1 wherein the ball is dimensioned for rolling contact with the bottom track portion and both side rails.

4. An amusement device in accordance with claim 1 wherein the ball has a diameter greater than the width of the track and less than that sufficient for the ball to contact the bottom track portion and both side rails.

5. An amusement device in accordance with claim 1 wherein the trackway is extruded polyethylene.

6. An amusement device in accordance with claim 1 wherein the side rails diverge, and are at an angle of from 30° to less than 90° to the plane of the trackway.

7. An amusement device as set forth in claim 1 wherein the means for holding said tubes includes a pair of parallel oppositely inwardly directed L-shaped flanges adjacent each end of said trackway the upstanding legs of said L-shaped flanges being shaped a distance sufficient for frictional engagement with opposite sides of said rectangular flange, and the laterally extending leg of said L-shaped flange is spaced from the underside of the trackway a distance for frictional engagement between the rectangular flange and the underside of said trackway.

8. An amusement device as set forth in claim 7 wherein the L-shaped flanges are co-extensive with said trackway.

9. An amusement device as set forth in claim 1 wherein numerical scoring indicia are provided at intervals intermediate the ends of said trackway.

* * * * *